US007479069B2

(12) United States Patent
Cheng et al.

(10) Patent No.: US 7,479,069 B2
(45) Date of Patent: Jan. 20, 2009

(54) INSERT FOR ALTERING THE STIFFNESS OF A GOLF CLUB SHAFT

(75) Inventors: Michael H. L. Cheng, 5369 Evening Sky Dr., Simi Valley, CA (US) 93063; Eric M. Jones, Orinda, CA (US)

(73) Assignee: Michael H. L. Cheng, Simi Valley, CA (US)

( * ) Notice: Subject to any disclaimer, the term of this patent is extended or adjusted under 35 U.S.C. 154(b) by 91 days.

(21) Appl. No.: 10/996,912

(22) Filed: Nov. 24, 2004

(65) Prior Publication Data

US 2005/0079925 A1 Apr. 14, 2005

(51) Int. Cl.
*A63B 53/00* (2006.01)

(52) U.S. Cl. ..... 473/318; 473/288; 473/289

(58) Field of Classification Search ..... 473/288, 473/289, 316, 318
See application file for complete search history.

(56) References Cited

U.S. PATENT DOCUMENTS 2,133,696 A * 10/1938 Hall ..... 473/299
2,508,039 A 5/1950 Neuwirth
3,773,375 A * 11/1973 Nehls ..... 37/268
3,833,223 A * 9/1974 Shulkin ..... 473/238
4,214,395 A * 7/1980 Caldwell, Jr. ..... 43/18.1 R
4,319,750 A 3/1982 Roy
4,561,922 A 12/1985 Peerman et al.
4,738,046 A * 4/1988 Fraylick et al. ..... 43/18.1 R
4,826,168 A * 5/1989 McGuire et al. ..... 473/295
4,893,519 A * 1/1990 Corso et al. ..... 74/551.9
5,054,781 A 10/1991 Soong
5,080,363 A 1/1992 Soong
5,205,552 A 4/1993 Green
5,588,920 A 12/1996 Soong
5,692,971 A 12/1997 Williams
5,735,752 A 4/1998 Antonious
5,904,627 A 5/1999 Miyaji et al.
6,045,457 A 4/2000 Soong
6,056,646 A 5/2000 Soong
6,056,648 A 5/2000 Kusumoto et al.
6,113,508 A 9/2000 Locarno et al.
6,155,932 A 12/2000 Cabales et al.
6,231,456 B1 5/2001 Rennie et al.
6,241,623 B1 6/2001 Laibangyang
6,257,997 B1 7/2001 Doble et al.
6,308,590 B1 * 10/2001 Berto ..... 74/551.8
6,349,451 B1 * 2/2002 Newman et al. ..... 16/427
6,354,960 B1 3/2002 Perryman et al.
6,361,451 B1 3/2002 Masters et al.

(Continued)

FOREIGN PATENT DOCUMENTS

JP 06-047115 A 2/1994

OTHER PUBLICATIONS

PCT Search Report dated May 28, 2008 for PCT App. Ser. No. PCT/US2008/051506.

*Primary Examiner*—William M Pierce
(74) *Attorney, Agent, or Firm*—Henricks, Slavin & Holmes LLP

(57) ABSTRACT

A golf accessory is provided that includes an insert for removably and interchangeably mounting within an interior of a golf club shaft for interchangeably altering a predetermined stiffness or bending moment of the club shaft.

34 Claims, 10 Drawing Sheets

U.S. PATENT DOCUMENTS

| | | | | |
|---|---|---|---|---|
| 6,364,787 | B1 | 4/2002 | Huiskamp | |
| 6,364,789 | B1 | 4/2002 | Kosmatka | |
| 6,485,376 | B1 | 11/2002 | Hisamatsu | |
| D479,293 | S | 9/2003 | Bergling Olson | |
| 6,656,058 | B2 * | 12/2003 | Thompson et al. | 473/318 |
| 6,666,778 | B2 | 12/2003 | Ashida | |
| 6,755,752 | B2 | 6/2004 | Shimizu et al. | |
| 6,764,414 | B2 | 7/2004 | Kumamoto | |
| 6,773,358 | B1 | 8/2004 | Sumitomo et al. | |
| 6,797,208 | B2 | 9/2004 | Schikner | |
| 2001/0005696 | A1 | 6/2001 | Hedrick | |
| 2002/0187850 | A1 | 12/2002 | Kluck et al. | |
| 2003/0027658 | A1 | 2/2003 | Li et al. | |
| 2005/0009620 | A1 | 1/2005 | Hodgetts | |

* cited by examiner

| | Material | | |
|---|---|---|---|
| | Type | FAW gram/sm | Angle |
| Layer # 1 | T700 | 100-120 | +50°-30° |
| Layer # 2 | T700 | 100-120 | +50°-30° |
| Layer # 3 | M30 | 100-120 | 0° |

| | Type | gram/sm | Angle |
|---|---|---|---|
| Layer # 1 | T700 | 100-120 | 90° |
| Layer # 2 | T700 | 100-120 | 0°-45° |
| Layer # 3 | M30 | 100-120 | 0°-45° |

| | Type | gram/sm | Angle |
|---|---|---|---|
| Layer # 1 | Scrim | 100-120 | 45° |
| Layer # 2 | T700 | 100-120 | 0°-45° |
| Layer # 3 | M30 | 100-120 | 0°-45° |

| | Type | gram/sm | Angle |
|---|---|---|---|
| Layer # 1 | T700 | 100-120 | 0°-45° |
| Layer # 2 | T700 | 100-120 | 0°-45° |
| Layer # 3 | Scrim | 100-120 | 45° |

FIG. 14

INSERT FOR ALTERING THE STIFFNESS OF A GOLF CLUB SHAFT

FIELD OF THE INVENTION

The present invention relates generally to an insert for a golf club and particularly to a golf club having a removable, interchangeable insert for interchangeably altering the stiffness or bend profile of the shaft of the golf club.

BACKGROUND OF THE INVENTION

A typical golf club includes a club head attached to a club shaft. The club head includes a face which is designed to contact a golf ball. An upper end of the club shaft often includes a comfortable grip, which a golfer grasps to manipulate the club.

During a typical golf swing, the golfer begins the swing with the club head adjacent to the golf ball. The golfer then pulls the club rearwardly and upwardly in an arcing motion called a backswing. At a top of the backswing, the golfer reverses the direction of the swing and brings the club downwardly and forwardly causing the club head to contact the golf ball.

Typically the shaft of the golf club is flexible, causing it to oscillate, or bend backwardly and forwardly, during a swing. At the beginning of the swing, the club is in a neutral position with the club shaft substantially straight. During the backswing momentum builds in the club and the reversal of the swing direction at the top of the backswing creates a force that causes the shaft to bend backwardly from the neutral position. This is commonly referred to as "shaft lagging."

As the shaft lagging reaches a maximum deflection, the stiffness of the shaft causes the shaft to naturally reverse directions and snap back in a forward direction towards the neutral position, and then move past the neutral position and bend forwardly from the neutral position into a position commonly referred to as "shaft leading." When the shaft leading reaches a maximum deflection, the stiffness in the shaft again causes the shaft to naturally reverse directions and snap back in a rearward direction towards the neutral position.

In order to maximize the distance of a golf shot, the golfer should contact the ball shortly after the shaft has reached its maximum shafting lagging position. In such an instance the power generated by the golfer's swing is enhanced by the shaft's natural tendency to shift or "kick" forward from the shaft lagging position to the neutral position. If the shaft has already shifted past the neutral position and into the shaft leading position when the club head contacts the ball, then the power generated by the golfer's swing is lessened by the shaft's natural tendency to shift backwardly from the shaft leading position to the neutral position.

As such, in order to maximize the distance of a golf shot the golfer should choose a golf club shaft having a stiffness that is appropriate for that golfer's particular swing. This choice is dependent on several factors such as the power generated by the golfer's swing and the speed of the golfer's swing. If a golfer chooses a shaft that is too stiff for that golfer's particular swing, then the shaft will not deflect sufficiently to generate a "kick" behind the golf ball. If a golfer chooses a shaft that is not stiff enough for that golfer's particular swing, then the shaft will either lag or lead excessively causing the ball to leave the club head at a launch angle that is lower or higher, respectively than desired.

Golfers often discover the appropriate club shaft stiffness to match their particular golf swing through trial and error. Accordingly, a need exists for an insert for removably and interchangeably attaching to a golf club for altering the stiffness or bend profile of the club shaft.

SUMMARY OF THE INVENTION

In one embodiment, the present invention is a golf accessory that includes an insert for removably and interchangeably mounting within an interior of a golf club shaft for interchangeably altering a predetermined stiffness or bending moment of the club shaft.

In another embodiment, the present invention is an assembly that includes a golf club shaft of a predetermined stiffness or bending moment having an elongated hollow rod; and an insert removably and interchangeably disposed within the hollow interior of the club shaft for interchangeably altering the predetermined stiffness or bending moment of the club shaft.

In yet another embodiment, the present invention is an assembly that includes a golf club shaft of a predetermined stiffness or bending moment having an elongated hollow rod with a length and an upper end; and an insert removably and interchangeably disposed within the hollow interior of the club shaft for interchangeably altering the predetermined stiffness or bending moment of the club shaft, wherein the insert includes an elongated hollow rod having a length and an upper end. In this embodiment the assembly further includes a grip that covers the upper ends and an upper portion of the lengths of the club shaft and the insert. In another embodiment, the grip includes a removable cap which, when removed, exposes the upper end of the insert.

In still another embodiment, the present invention is an assembly that includes a golf club shaft of a predetermined stiffness or bending moment having an elongated hollow rod with a length and an upper end; and a insert removably and interchangeably disposed within the hollow interior of the club shaft for interchangeably altering the predetermined stiffness or bending moment of the club shaft. The insert includes an elongated hollow rod having a length and an upper end. The insert forms a removable press fit coupling with the club shaft. The assembly also includes a plug fixedly attached to an inner wall of the insert for removably receiving a removal tool that facilitates removal of the insert from the club shaft; and a grip that covers the ends and an upper portion of the lengths of the club shaft and the insert, wherein the grip includes a removable cap which, when removed, exposes the upper end of the insert.

In a further embodiment the insert includes a first portion that has a different stiffness value or bend profile than a remaining portion of the insert. In another embodiment, the removable cap is lockingly secured when attached to the remainder of the golf club.

BRIEF DESCRIPTION OF THE DRAWINGS

FIG. 14 is a chart showing various exemplary material composition of an insert according to the present invention;

DETAILED DESCRIPTION OF THE DRAWINGS

As shown in FIGS. 1-16, embodiments of the present invention are directed to an insert for a golf club shaft for altering the stiffness or bend profile of the shaft. In one embodiment, the insert is removably attached to the club shaft so that the insert can be replaced by any one of a plurality of different inserts, each having a different stiffness value or bend profile, so that the stiffness or bend profile of the club shaft can be altered to any one of a plurality of different stiffness values or any one of a plurality of different bend profiles.

Figure 1:
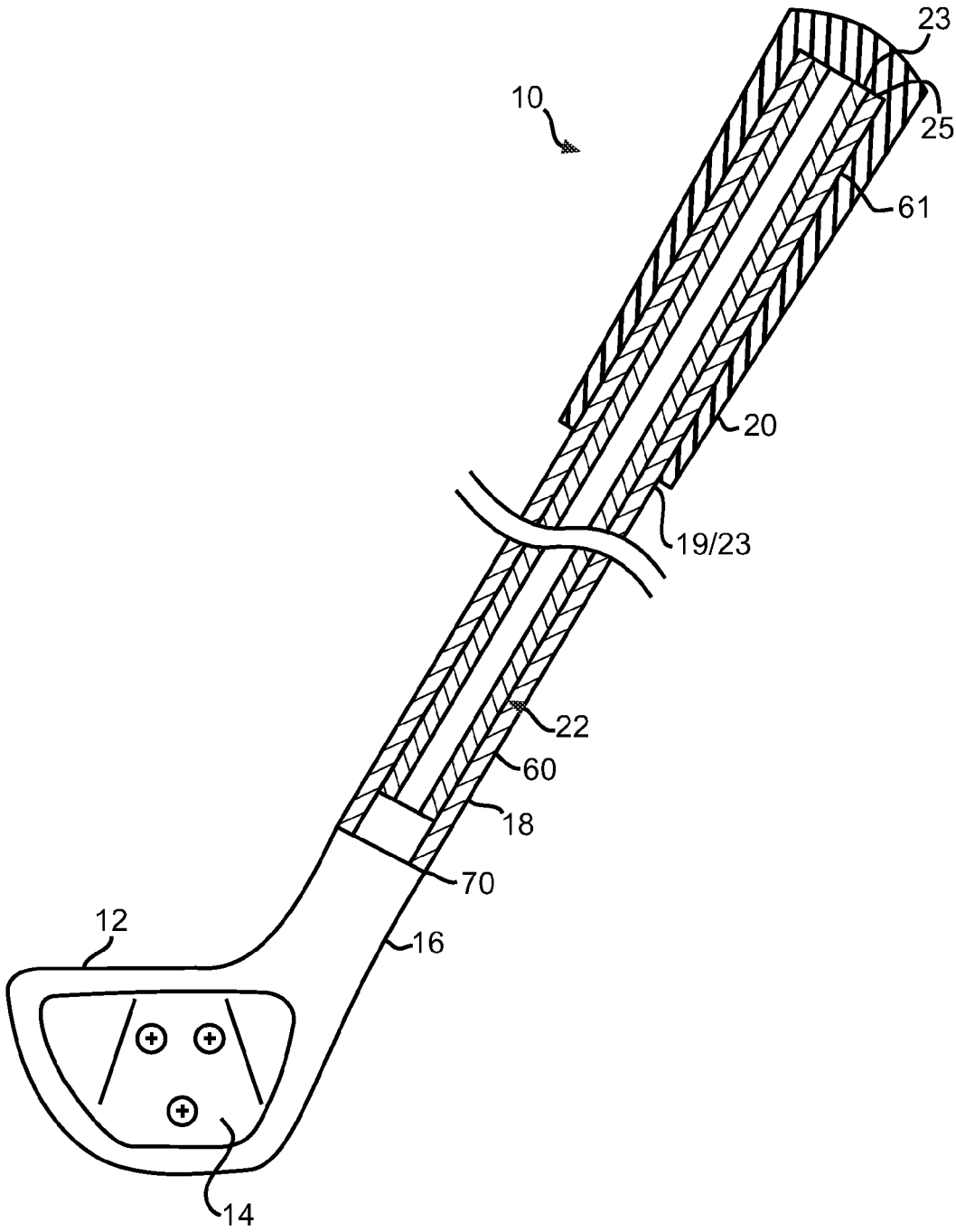
FIG. 1 is a side view of one embodiment of a golf club according to the present invention.

FIG. 1 shows a golf club 10 according to one embodiment of the invention. In the depicted embodiment, the golf club 10 includes a club head 12 having a club face 14 which is designed to contact a golf ball. The club head 12 also includes a hosel 16 for connecting the club head 12 to a club shaft 18. The club shaft 18 is an elongated cylindrical rod having a hollow interior 19. A grip 20 is attached in surrounding relation to an upper portion of the club shaft 18.

The club shaft 18 is manufactured to a predetermined stiffness or bending moment. This predetermined stiffness value and bending moment can be altered by placing an insert 22 within the club shaft 18. In one embodiment, the insert 22 is an elongated cylindrical rod having a hollow interior 23. In the embodiment of FIG. 1, the outer perimeter of the insert 20 and the inner perimeter of the club shaft 18 are close in dimension such that the insert 22 forms a press fit coupling with the club shaft 18 and is held therein by frictional forces between contacting surfaces of the insert 22 and the club shaft 18.

The upper portion of the club shaft 18 (i.e., that portion in proximity to the grip 20) is sometimes referred to as a butt section or a butt; and the lower portion of the club shaft 18 (i.e., that portion in proximity to the club head 12) is sometimes referred to as a tip section or a tip. This terminology also applies to the insert 22.

In one embodiment, the outside perimeter of the insert 22 is coated with a coating to improve the fit between the insert 22 and the club shaft 18. This coating also helps reduce any noise that may result from the frictional engagement of the insert 22 and the club shaft 18. In one embodiment, the coating is a soft coating, such as a polyurethane based coating.

Preferably, the insert 22 is removably attached to the club shaft 18 so that the insert 22 can be replaced by any one of a plurality of different inserts, each having a different stiffness value or bending moment, so that the stiffness or bending moment of the club shaft 18 can be altered to any one of a plurality of different stiffness values or bending moments.

As shown in FIG. 1, the insert 22 is enclosed within the combination of the club shaft 18 and the grip 20. That is, the length of the insert 22 is covered by the club shaft 18 and the upper end of the insert 22 is covered by the grip 20. As such, in order to remove the insert 22 from the club shaft 18, the grip 20 is removed to expose upper ends 23 and 25, respectively, of the insert 22 and the club shaft 18.

Although FIG. 1 shows the club head 12 as being a typical driver type club head, any type of club head may be used in accordance with the present invention, such as club heads commonly referred to as "woods," "irons," and "wedges" among other club heads. Also, although specific embodiments of the club shaft 18, the insert 22 and the grip 20 are shown in FIG. 1, alternative club shafts, inserts and grips are disclosed below, various combinations of which may be used to create alterative embodiments of the invention.

For example, in the embodiment of FIG. 1, the grip 20 is a continuous integrally formed piece. In this embodiment, when removal and/or replacement of the insert 22 is desired, the entire grip 20 is removed from the club shaft 18 in order to expose the insert 22. However, in other embodiments, the grip includes a removable cap. In such embodiments, when removal and/or replacement of the insert 22 is desired, only the cap needs to be removed in order to expose the insert 22.

Figure 2A:
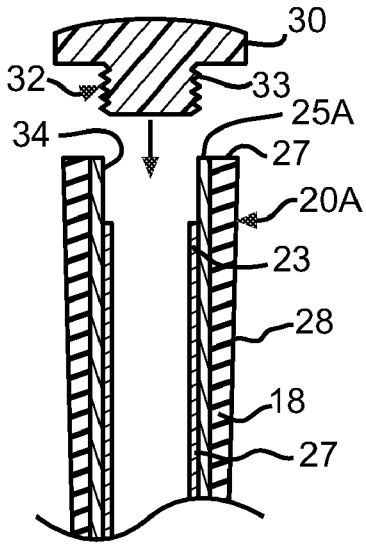
FIG. 2A is a an exploded side view of one embodiment of a grip for use with a golf club according to the present invention.

FIG. 2A shows one such embodiment. This embodiment includes a grip 20A having a main body 28. The main body 28 of the grip 20A covers an upper portion of the length of a club shaft 18A (similar to the covering of the grip 20 over the upper portion of the length of the club shaft 18 as shown in FIG. 1.) The insert 22 is removably disposed within the club shaft 18 as described above. A grip cap 30 removably covers upper ends 23, 25A and 27, respectively, of the insert 22, the club shaft 18 and the main body 28 of the grip 20A.

In this embodiment, the grip cap 30 includes a downwardly extending ribbed section 32 having outwardly extending ribs 33 that form a removable press fit coupling with an upper portion 34 of the club shaft 18A, when the ribs 33 frictionally engage the inner sidewalls of the upper portion 34 of the club shaft 18A.

Figure 2B:
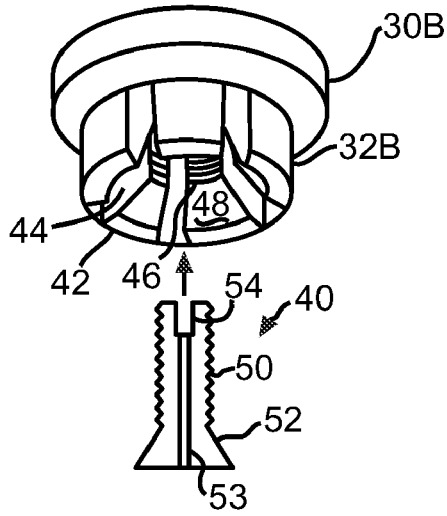
FIG. 2B is a perspective view of another embodiment of a removable grip cap for use with a golf club according to the present invention.

FIG. 2B shows another embodiment where the grip includes a removable cap 30B. Although not shown, the removable grip cap 30B is removably attached to a grip main body 28 such as that shown in FIG. 2A. As shown, the grip cap 30B includes a downwardly extending section 32B, which is radially extendable to pressingly engage the inner sidewalls of the upper portion 34 of the club shaft 18. As shown, the radially extendable section 32B includes a plurality of movable segments 42 each separated by a slot 44, which allows for the radial movement of the section 32B when the segments are moved as by a tool 40 as discussed below.

Each of the movable segments 42 includes a threaded inner wall 46 and an angled ramp section 48 adjacent to the threaded inner wall 46. The grip cap 30B similarly includes an opening 51 having internal threads 47 (see FIGS. 3 and 4), which are aligned with the threaded inner walls 46 of the movable segments 42. The tool 40 includes external threads 50, which threadably engage both the threaded inner walls 46 of the movable segments 42 and the internal threads 47 of the grip cap 30B. The tool 40 also includes an angled ramp section, such as a countersunk head 52, for engagement with the ramp sections 48 of the moveable segments 42.

Figure 3:
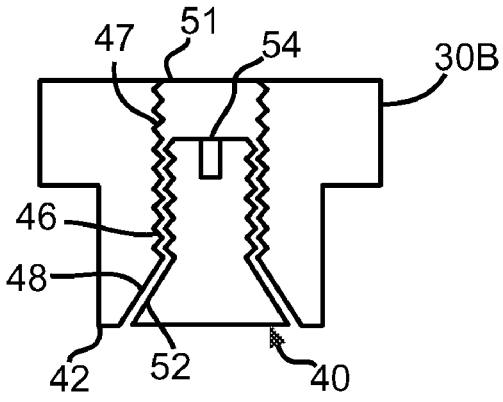
FIG. 3 is a cross sectional view of the grip cap of FIG. 2B in a natural condition.
Figure 4:
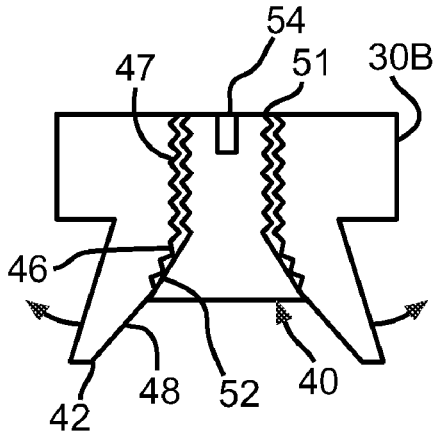
FIG. 4 is a cross sectional view of the grip cap of FIG. 2B in a radially extended condition.

FIG. 3 shows the tool 40 inserted into the grip cap 30B prior to a radial movement of the movable segments 42. In the position shown in FIG. 3, the largest portion of the countersunk head 52 of the tool 40 is in contact with the largest portion of the ramp sections 48 of the moveable segments 42. As the tool 40 is moved upwardly with respect to the grip cap 30B from the position of FIG. 3 to the position of FIG. 4, the largest portion of the countersunk head 52 progressively contacts smaller and smaller sections of the ramp sections 48 of the moveable segments 42. Each time the largest portion of the countersunk head 52 meets a portion of the ramp sections 48 that is smaller than itself, it imparts a force on the smaller ramp sections causing the moveable segments 42 to extend radially outward as shown by the arrows in FIG. 4.

In one embodiment, the grip cap 30B is removably connected to the main body 28 of the grip 20B by inserting the radially extendable section 32B within the inner sidewalls of the upper portion 34B of the club shaft 18. The tool 40 may then be threadingly engaged with the threads of the threaded inner walls 46 of the movable segments 42 and the internal threads 47 of the grip cap 30B. In one embodiment, the tool 40 includes a keyway 54 accessible from the opening 51 in the grip cap 30B. A key (not shown) may be inserted into the keyway 54 to rotate the tool 40 until the movable segments 42 have been radially extended to a desired amount to obtain a desired level of press fitting between the moveable segments 42 of the radially extendable section 32B of the grip cap 30B and the inner sidewalls of the upper portion 34B of the club shaft 18. In alternative embodiments, only the grip cap opening 51 or only the movable segment inner walls 46 are threaded.

In one embodiment, the tool 40 is a screw having a countersunk head, and the keyway 54 of the tool 40 is an opening for receipt of an Allen wrench. When the radially extendable section 32B of the grip cap 30B is compressed against the inner sidewalls of the upper portion 34B of the club shaft 18 by an appropriate amount, the grip cap 30B will not move. Thus, the removable connection of the grip cap 30B should comply with the United States Golf Association regulations which specify that golf clubs may not have movable parts. In one embodiment, the tool 40 includes an air passageway 53. The air passageway allows for movement of the tool 40 without changing the air pressure within the club shaft 18.

Figure 2C:
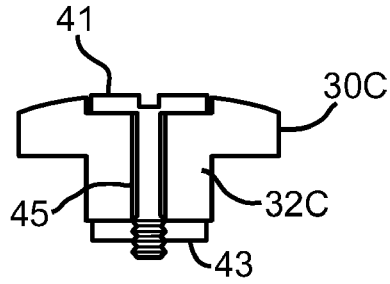
FIG. 2C is a side view of yet another embodiment of a removable grip cap for use with a golf club according to the present invention.

FIG. 2C shows another embodiment where the grip includes a removable cap 30C. Again, although not shown, the removable grip cap 30C is removably attached to a grip main body 28 such as that shown in FIG. 2A. As shown, the grip cap 30C includes a downwardly extending section 32C, which is radially extendable to pressingly engage the inner sidewalls of the upper portion 34 of the club shaft 18. In this embodiment, at least the radially extendable section 32C, and preferably the entire grip cap 30C, is composed of an elastic material, such as rubber or another similar polymer, among other appropriate materials.

The interaction of a tool 41 and a disk 43 cause the radial expansion of the radially extendable section 32C. As shown, the grip cap 30C includes an opening 45 for receiving the tool 41 and a recessed portion for receiving the head of the tool 41. The disk 43 is non-rotatably affixed to the grip cap 30C. The tool 41 includes external treads that mate with internal threads in the disk 43. Threading the tool 41 into the disk 43 causes the head of the tool 41 to move relative to the disk. When the head of the tool 41 moves toward the disk 43, the material therebetween is compressed, causing the radially extendable section 32C to radially expand. When the grip cap 30C is inserted into the club shaft 18, this radial expansion may continue until the radially extendable section 32C pressingly engages the inner sidewalls of the upper portion 34 of the club shaft 18.

In one embodiment, the head of the tool 41 includes an opening for receiving the head of an Allen wrench. Also, in one embodiment, the disk 41 may be integrally formed with or otherwise non rotatably affixed to a multisided element, such as a hex nut, and the grip cap 30C may have a corresponding multisided recess for receiving the multisided element. The interaction of the multisided recess with the multisided element prevents rotation of the disk 43 during the threading engagement of the tool 41 with the disk 43. However, in other embodiments, the disk 43 may be mounted to the grip cap 30C by an appropriate manner for preventing rotatable motion between the disk 43 and the grip cap 30C. The tool 41 may also include an air passageway as described above with respect to FIG. 2B.

Figure 5:
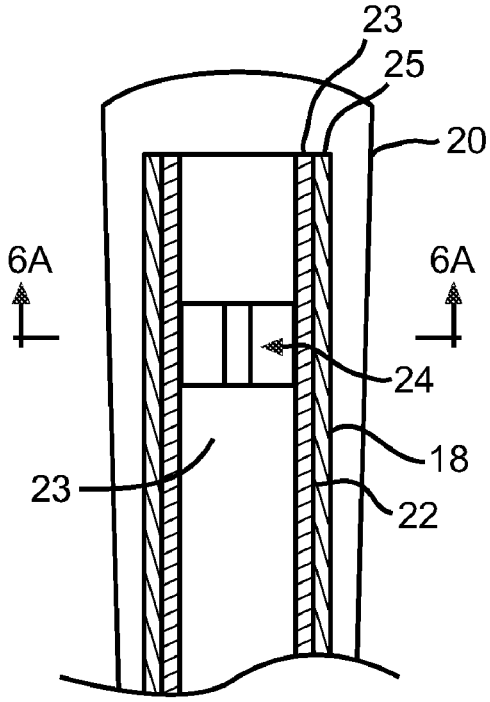
FIG. 5 is a cross-sectional view of an upper portion of one embodiment of a golf club according to the present invention showing a plug affixed to an insert.

FIGS. 5-7B show methods for removing the insert 22 from the club shaft 18. Although the grip 20 and club shaft 18 of FIG. 1 are depicted in FIGS. 5-7B, any of the previously mentioned grips and club shafts may be used with the removal technique depicted in FIGS. 5-7B and described immediately below. As shown in FIG. 5, a plug 24 is fixedly attached to a internal wall of the insert 22 by any appropriate attachment means. For example, the plug 24 may be affixed to the insert 22 by means of an adhesive, such as an epoxy.

The plug 24 facilitates removal of the insert 22 from the club shaft 18 by allowing a tool 28 to be inserted through the upper ends 23 and 25, respectively, of the insert 22 and the club shaft 18 (assuming that the grip and/or grip cap has been removed to expose these upper ends 23 and 25.) The tool 28 can then be attached to the plug 24 and pulled upwardly with respect to the club shaft 18 until the insert 22 has been removed from the club shaft 18.

Figure 6A:
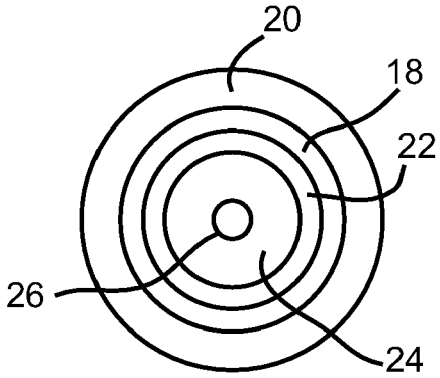
FIG. 6A is a cross-sectional view of the golf club of FIG. 5 taken along line 6A-6A of FIG. 5.
Figure 7A:
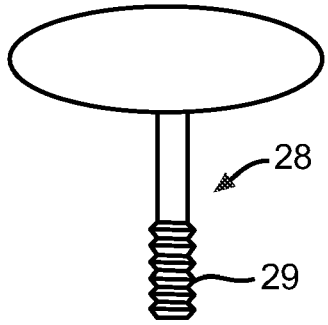
FIG. 7A is a tool for use with the plug of FIG. 6A.

The attachment of the tool 28 to the plug 24 may be made by any removable attachment means appropriate for allowing the tool 28 to remain in engagement with the plug 24 during removal of the insert 22 from the club shaft 18. In the embodiment of FIGS. 6A and 7A, the tool 28 includes an externally threaded section 29 for threadably engaging an internally threaded opening 26 in the plug 24. This threaded engagement provides a strong removable attachment between the tool 28 and the plug 24 that ensures engagement of the tool 28 with the plug 24 throughout the removal process of the insert 22.

Figure 6B:
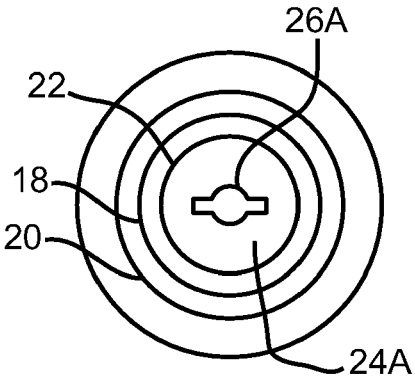
FIG. 6B is a cross-sectional view of an alternative plug affixed to an insert according to the present invention.
Figure 7B:
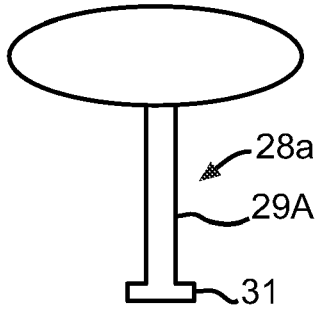
FIG. 7B is a tool for use with the plug of FIG. 6B.
Figure 8:
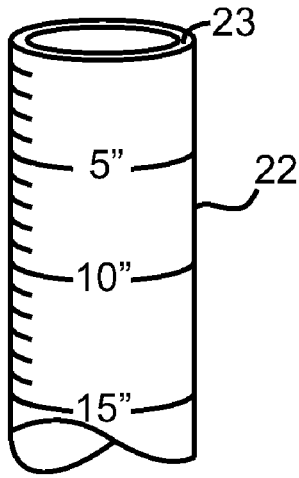
FIG. 8 is a side view of an upper portion of one embodiment of an insert according to the present invention showing dimensional markings on the outer surface thereof.

In the embodiment of FIGS. 6B and 7B, the tool 28A includes an a key 29A for insertion into a keyway 26A in the plug 24A. When the key 29A is inserted in the keyway 26A, the key 29A may be rotated to engage the plug 24A and allow for removal of the insert 22 from the club shaft 18. For example, in the embodiment of FIGS. 6B and 7B, the key 29A has a protruding end 31, which once inserted into and through the keyway 26A and rotated, blockingly abuts a lower surface of the plug 24A to allow for removal of the insert 22.

Referring back to FIG. 1, when the club head 12 strikes a golf ball, stress is distributed throughout the club shaft 18 and the insert 22. Since the sections of club shaft nearest the tip of the insert 22 are most susceptible to fracture, in one embodiment, a lower portion 60 of the insert 22 is more flexible than a remainder of the insert 22. By way of example only, in one embodiment, the more flexible lower portion 60 of the insert 22 includes approximately the lowest four inches of the insert 22.

Figure 9:
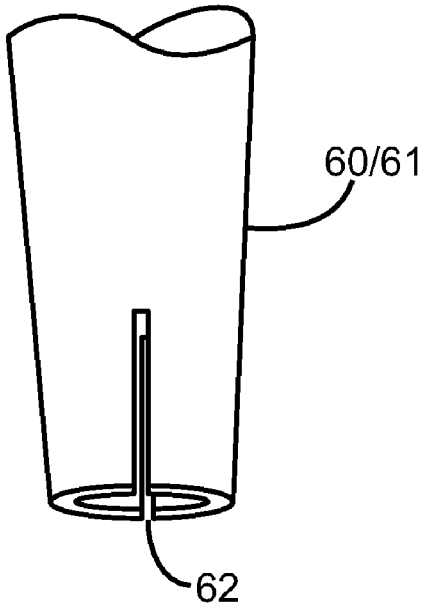
FIG. 9 is a perspective view of a lower portion of one embodiment of an insert according to the present invention.

The lower portion 60 or of the insert 22 may be made to be more flexible than the remainder of the insert 22 by any one of a variety of appropriate means, such as any combination of one or more of the following:

- manufacturing the lower portion 60 of the insert 22 from a softer material than the material used in the remainder of the insert 22;
- forming one or more slots, (FIG. 9 shows such a slot 60 formed in the lower portion 60 of the insert 22) for example by cutting the lower portion 60 of the insert 22 with a saw or water jet cutter (in one embodiment, four slots are formed in the lower portion 60 of the insert 22); and
- forming the lower portion 60 of the insert 22 with a thinner wall thickness than the wall thickness of the remainder of the insert 22.

In another embodiment, an upper portion 61 of the insert 22 is more flexible than a remainder of the insert 22. the upper portion 61 of the insert 22 may be made to be more flexible that the remainder of the insert 22 by any of the methods described above with respect to the lower portion 60 of the insert 22.

Preferably, the insert 22 is relatively light in weight. As such, in one embodiment, the insert 22 is manufactured from a light weight material such as graphite, plastic, or another polymer, among other appropriate materials. In one embodiment, the insert 22 is less than approximately 15 grams. Typically, the overall length of the insert 22 is approximately 20 inches to approximately 30 inches. However, this insert 22 may be manufactured to any desired length. In addition, after manufacture, the length of the insert 22 may be altered by cutting the insert 22 to a desired length. In one embodiment, such as that shown in FIG. 8, the insert 22 includes incremental dimensional markings along its length so that an accurate cut may be made if shortening of the insert 22 is desired; and also so that various interchangeable inserts may each be cut accurately to the same length.

In embodiments where the insert 22 is composed of graphite, the insert 22 may be manufactured by any appropriate manufacturing technique such as sheet-wrapping, filament-winding, and internal bladder molding, among other appropriate techniques. In embodiments where the insert 22 is composed of plastic, the insert 22 may be manufactured by any appropriate manufacturing technique such as injection molding, among other appropriate techniques.

For example, the insert 22, according to one embodiment of the invention, is made in a graphite sheet-wrapping method of manufacturing that includes three layers of material. In this embodiment, the first layer of material is a light weight scrim with pre-preg area weight of approximately 100 grams per square meter or less. This layer is wound around a mandrel for one full circle. The second layer may be made of any one of the common Toray graphite materials, such as Toray T700, M30, M40J, M46J or M50J. This layer is also wound around the mandrel for one full circle. The third layer can also be made of any of the Toray graphite materials listed above.

FIG. 14 shows various combinations of materials used is a sheet-wrapping process for producing various inserts according to the present invention. It should be understood that these combinations are merely exemplary and not intended to be an exhaustive list. In FIG. 14, the first column indicates the type of material, the second column indicates the weight of the material (in units of grams per square meter) and the third column indicates the angle of the graphite fibers with respect to the longitudinal axis of the insert 22.

In one embodiment, to increase the flexibility of the lower portion 60 of the insert 22, the second layer is made of two pieces of pre-preg with a lower portion of the second layer (corresponding to the lower portion 60 of the insert 22) being made with a material that has a lower modulus rating than the remainder of the insert 22. In one embodiment, the first and third layers are reversed. During the manufacturing process, the three layers may be stacked together and rolled in one single action. This process may also be used to increase the flexibility of the upper portion 61 of the insert 22.

Figure 10:
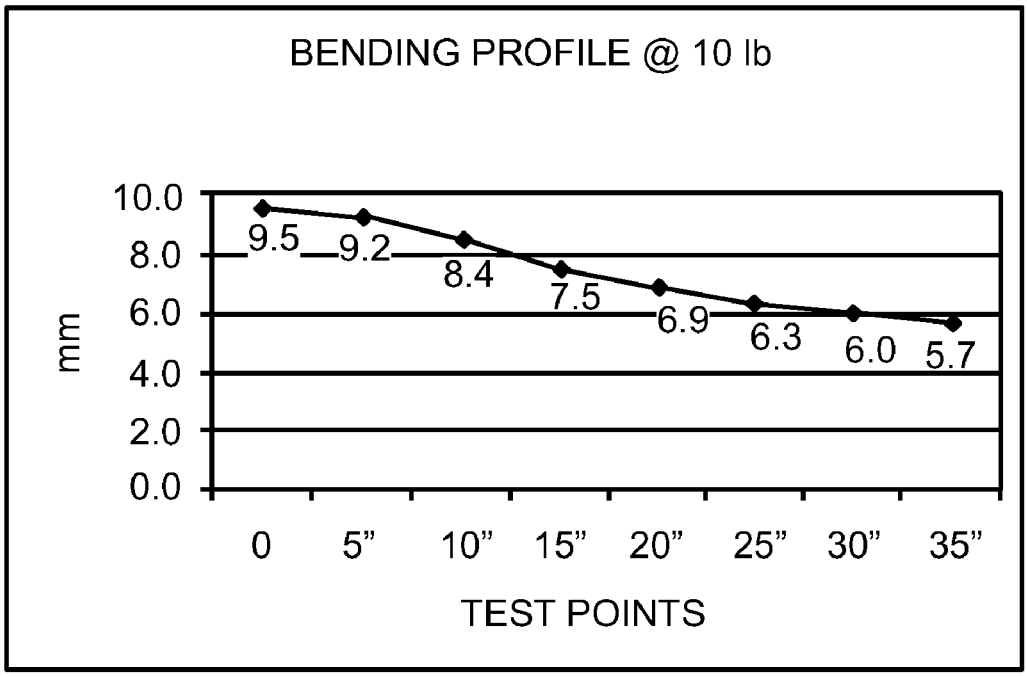
FIG. 10 shows the bending profile of a club shaft according to one embodiment of the invention.

FIG. 10 shows the bending profile of a club shaft according to one embodiment of the invention. The bending profile shows the deflection in millimeters of the club shaft when 10 pounds of weight are applied to various points along the length of the club shaft, with 0 inches being the tip of the club shaft 18, and with each successive test point being incrementally increased 5 inches therefrom.

Figure 11:
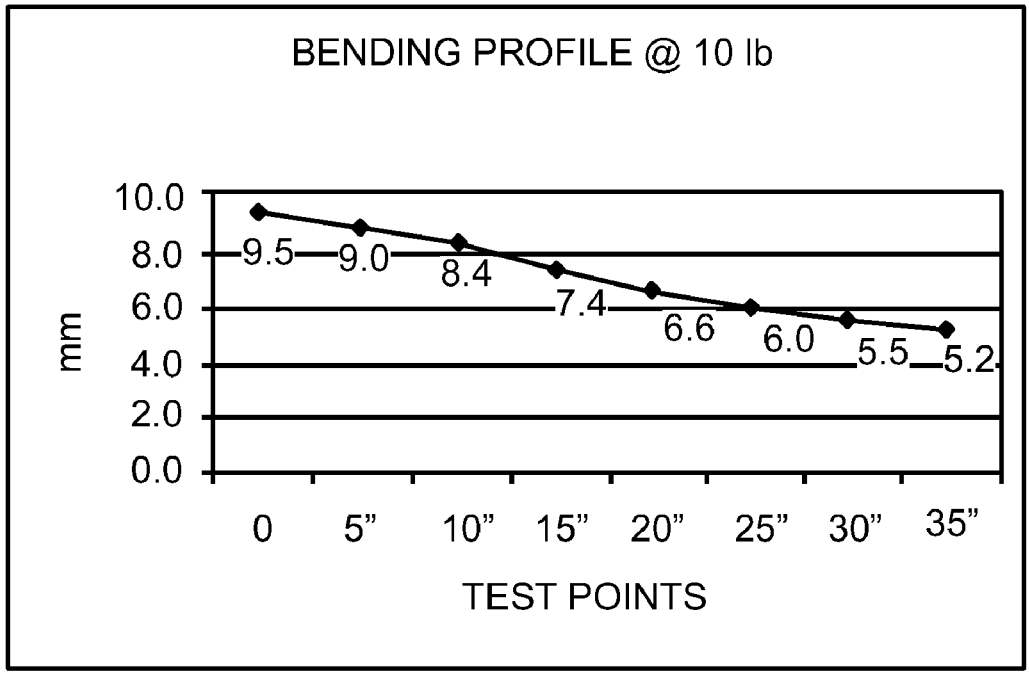
FIG. 11 shows a bending profile similar to FIG. 10 with an insert according to one embodiment of the present invention inserted within the club shaft that was used to create the bending profile of FIG. 10.
Figure 12:
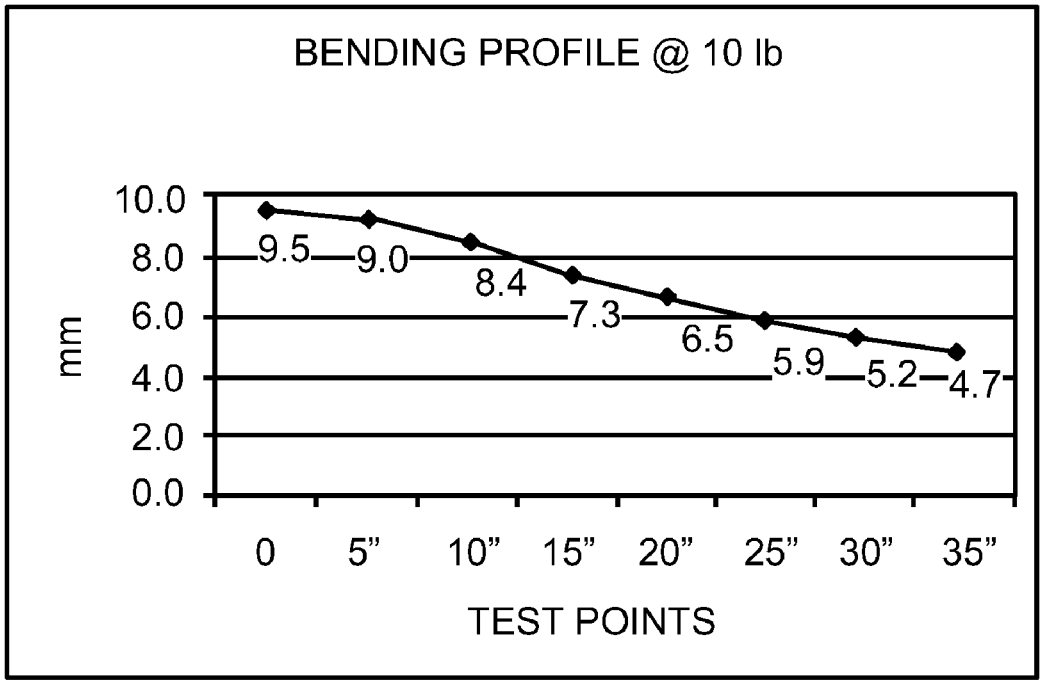
FIG. 12 shows a bending profile similar to FIG. 10 with an insert, which is stiffer than the insert of FIG. 11, inserted within the club shaft that was used to create the bending profile of FIG. 11.
Figure 13:
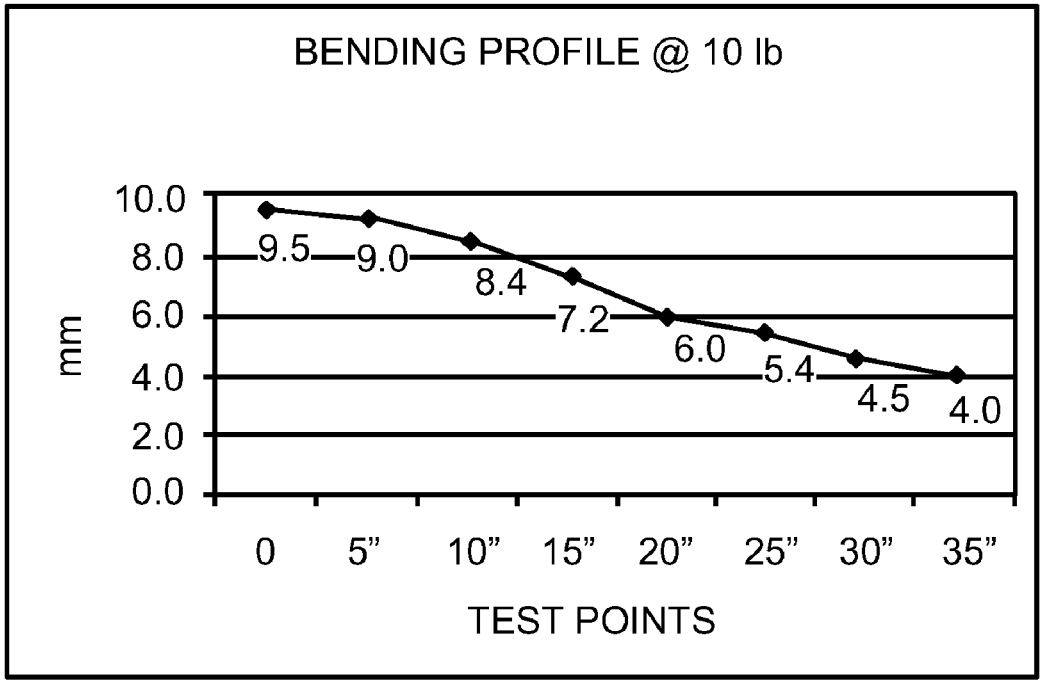
FIG. 13 shows a bending profile similar to FIG. 10 with an insert, which is stiffer than the insert of FIG. 12, inserted within the club shaft that was used to create the bending profile of FIG. 10.

FIGS. 11-13 show bending profiles similar to FIG. 10 with progressively stiffer inserts inserted within the club shaft that was used to create the bending profile of FIG. 10, with FIG. 11 having the least stiff insert and FIG. 13 having the stiffest insert.

Figure 15:
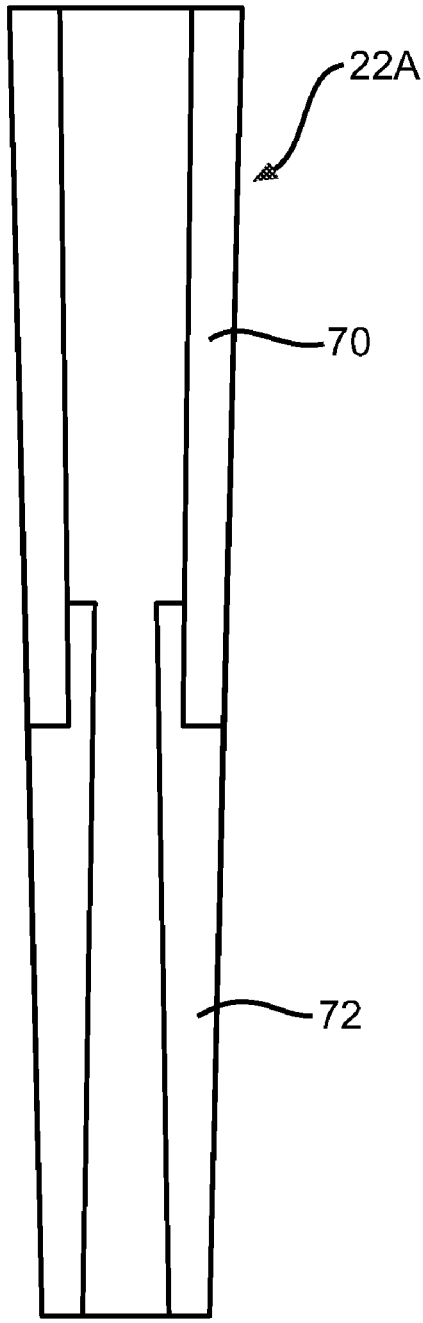
FIG. 15 is an exemplary insert according to one embodiment of the invention wherein upper and lower portions of the insert are made of materials having different stiffnesses or bending profiles.

To further broaden the possible bend profiles of the insert, the insert can be in two sections that are joined together. FIG. 15 shows such an insert 22A. In this embodiment, an upper portion 70 of the insert 22A and a lower portion 72 of the insert 22A are made of materials having different stiffnesses or bending profiles. For example in one embodiment, one of the portions 70 or 72 is composed of a plastic material and the other of the portions 72 or 70 is composed of a graphite material. The upper and lower portions 70 and 72 may be joined by any appropriate method.

Figure 16:
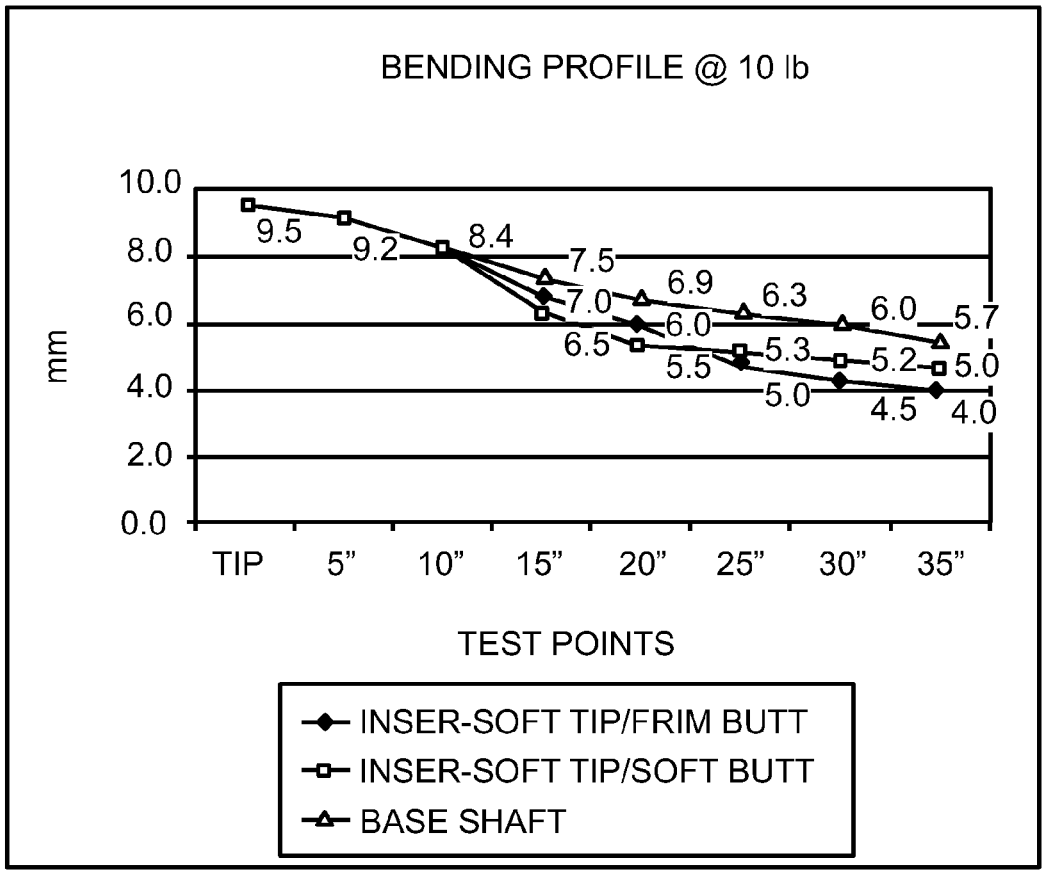
FIG. 16 shows bending profiles of club shafts according to various embodiments of the invention.

FIG. 16 shows the bending profile of a club shaft according to one embodiment of the invention. The bending profile shows the deflection in millimeters of the club shaft when 10 pounds of weight are applied to various points along the length of the club shaft, with 0 inches being the tip of the club shaft 18, and with each successive test point being incrementally increased 5 inches therefrom.

Data points shown with a triangle shape indicate a club shaft 18 without an insert mounted therein. Data points shown with a diamond shape indicate a club shaft 18 having an insert 22A inserted therein with the lower portion 72 made from a material that is more flexible than the material of the upper portion 70. Data points shown with a square shape indicate a club shaft 18 having an insert 22A inserted therein with the upper portion 70 made from a material that is more flexible than the material of the lower portion 72.

In one embodiment, multiple inserts 22 are made and provided in a set, with each insert 22 having a different stiffness or bending moment so that the multiple inserts 22 may be in turn removably and interchangeably inserted into the club shaft 18 to alter the stiffness or bending moment of the club shaft 18. A golfer may then compare the various inserts 22 to one another and select the one best suited for that golfer's particular swing. The golfer might also adjust the stiffness of the club shaft 18 for different golf courses or for other situations. As such, a club shaft 18 with various stiffnesses or bending moments can be obtained without the need for multiple club shafts.

The preceding description has been presented with reference to various embodiments of the invention. Persons skilled in the art and technology to which this invention pertains will appreciate that alterations and changes in the described structures and methods of operation can be practiced without meaningfully departing from the principle, spirit and scope of this invention.

What is claimed is:

1. An assembly for use with a tool having tool threads, the assembly comprising:

an elongate golf club shaft defining a hollow interior and a predetermined stiffness or bending moment;

an insert having an inner wall and adapted to be removably and interchangeably disposed within the hollow interior of the golf club shaft and to interchangeably alter the predetermined stiffness or bending moment of the golf club shaft; and a plug fixedly attached to the inner wall of the insert and including a threaded opening configured to engage the tool threads.

2. The assembly of claim 1, wherein the insert forms a removable press fit coupling with the golf club shaft.

3. The assembly of claim 1, wherein the insert comprises a first portion and a second portion and the first portion has a different stiffness than the second portion.

4. The assembly of claim 1, wherein the insert comprises a first portion and a second portion and the first portion is made with a different material than the second portion.

5. The assembly of claim 1, wherein the insert comprises a first portion that is more flexible than a remaining portion of the insert.

6. The assembly of claim 5, wherein the first portion of the insert is composed of a softer material than the remaining portion of the insert.

7. The assembly of claim 5, wherein the first portion of the insert comprises a thinner sidewall thickness than a sidewall thickness of the remaining portion of the insert.

8. The assembly of claim 5, wherein the first portion of the insert comprises at least one slot.

9. An assembly for use with a tool having a tool key shaft, the assembly comprising:

an elongate golf club shaft defining a hollow interior and a predetermined stiffness or bending moment;

an insert having an inner wall and adapted to be removably and interchangeably disposed within the hollow interior of the golf club shaft and to interchangeably alter the predetermined stiffness or bending moment of the golf club shaft; and a plug fixedly attached to the inner wall of the insert and including a keyway configured to engage the tool key shaft.

10. The assembly of claim 1, further comprising a grip that covers an upper portion of golf club shaft and the insert.

11. The assembly of claim 10, wherein the grip comprises a removable cap which, when removed, exposes an upper end of the insert.

12. The assembly of claim 10, wherein the removable grip cap comprises a ribbed section that forms a removable press fit coupling with an upper portion of the golf club shaft.

13. The assembly of claim 10, wherein the removable grip cap comprises a base section and a radially extending section extending downwardly therefrom, wherein an outward radial movement of the radially extending section causes the radially extending section to pressingly engage an inner wall of the golf club shaft to secure the grip cap to the golf club shaft.

14. The assembly of claim 13, wherein the radially extending section comprises a plurality of moveable segments each having an angled ramp, and wherein the golf club further comprises a tool having an angled ramp for contacting the angled ramps of the moveable segments, such that a movement of the tool causes its angled ramp to apply a force on the angled ramps of the moveable segments, which in turn causes a radial movement of the moveable segments and thus a radial movement of the radially extending section.

15. The assembly of claim 14, wherein the removable grip cap comprises a threaded section and the tool comprises a corresponding threaded section, such that said movement of the tool, which causes the radial movement of the radially extending section, is caused by a threading engagement of the threaded sections of the removable grip cap and the tool.

16. The assembly of claim 13, further comprising a disk non-rotatably mounted to the removable grip cap and threadably receiving a tool, and wherein the radially extending section is composed of an elastic material such that a threading engagement of the tool with the disk causes the radial movement of the radially extending section.

17. An assembly comprising:

a golf club including a club head and an elongate hollow golf club shaft attached to the club head and defining a hollow interior, a predetermined stiffness or bending moment, a length and an upper end;

an elongate hollow insert defining an inner wall, a length and an upper end and adapted to be removably and interchangeably disposed within the hollow interior of the golf club shaft and to interchangeably alter the predetermined stiffness or bending moment of the golf club shaft;

a tool including a threaded portion with tool threads;

a plug fixedly attached to the inner wall of the insert and including a threaded opening configured to engage the tool threads; and a grip that covers the upper ends and an upper portion of the lengths of the golf club shaft and the insert.

18. The assembly of claim 17, wherein the grip comprises a removable cap which, when removed, exposes the upper end of the insert.

19. The assembly of claim 18, wherein the removable grip cap comprises a ribbed section that forms a removable press fit coupling with an upper portion of the golf club shaft.

20. The assembly of claim 18, wherein the removable grip cap comprises a base section and a radially extending section extending downwardly therefrom, wherein an outward radial movement of the radially extending section causes the radially extending section to pressingly engage an inner wall of the golf club shaft to secure the grip cap to the golf club shaft.

21. The assembly of claim 20, wherein the radially extending section comprises a plurality of moveable segments each having an angled ramp, and wherein the golf club further comprises a tool having an angled ramp for contacting the angled ramps of the moveable segments, such that a movement of the tool causes its angled ramp to apply a force on the angled ramps of the moveable segments, which in turn causes a radial movement of the moveable segments and thus a radial movement of the radially extending section.

22. The assembly of claim 21, wherein the removable grip cap comprises a threaded section and the tool comprises a corresponding threaded section, such that said movement of the tool, which causes the radial movement of the radially extending section, is caused by a threading engagement of the threaded sections of the removable grip cap and the tool.

23. The assembly of claim 17, wherein the insert forms a removable press fit coupling with the golf club shaft.

24. An assembly comprising:

a golf club including a club head and an elongate hollow golf club shaft attached to the club head and defining a hollow interior, a predetermined stiffness or bending moment, a length and an upper end;

an elongate hollow insert defining an inner wall, a length and an upper end and adapted to be removably and interchangeably disposed within the hollow interior of the golf club shaft and to interchangeably alter the predetermined stiffness or bending moment of the golf club shaft;

a tool including a tool key shaft;

a plug fixedly attached to the inner wall of the insert and including a keyway configured to engage the tool key shaft; and a grip that covers the upper ends and an upper portion of the lengths of the golf club shaft and the insert.

25. The assembly of claim 17, wherein the insert comprises a first portion and a second portion and the first portion has a different stiffness than the second portion.

26. The assembly of claim 17, wherein the insert comprises a first portion and a second portion and the first portion is made with a different material than the second portion.

27. The assembly of claim 17, wherein the insert comprises a first portion that is more flexible than a remaining portion of the insert.

28. The assembly of claim 27, wherein the first portion of the insert is composed of a softer material the remaining portion of the insert.

29. The assembly of claim 27, wherein the first portion of the insert comprises a thinner sidewall thickness than a sidewall thickness of the remaining portion of the insert.

30. The assembly of claim 27, wherein the first portion of the insert comprises at least one slot.

31. The assembly of claim 1, wherein the entire plug is located within the insert.

32. The assembly of claim 9, wherein the entire plug is located within the insert.

33. The assembly of claim 17, wherein the entire plug is located within the insert.

34. The assembly of claim 24, wherein the entire plug is located within the insert.

* * * * *